United States Patent [19]

Matsui

[11] Patent Number: 4,873,505

[45] Date of Patent: Oct. 10, 1989

[54] ELECTRIC NOISE ABSORBER

[75] Inventor: Kazuhiro Matsui, Toyoake, Japan

[73] Assignee: Kitagawa Industries Co., Ltd., Aichi, Japan

[21] Appl. No.: 180,462

[22] Filed: Apr. 11, 1988

[30] Foreign Application Priority Data

May 29, 1987 [JP] Japan ..... 62-84514

[51] Int. Cl.[4] ..... H01F 17/06; H01F 27/02; H01F 27/26

[52] U.S. Cl. ..... 336/92; 324/127; 333/12; 336/176; 336/212; 336/233

[58] Field of Search ..... 324/127; 174/92; 333/81 R, 12, 182, 243, 183; 336/100, 174, 175, 233, 176, 92, 229, 210, 212, 90, 192

[56] References Cited

U.S. PATENT DOCUMENTS

| | | | |
|---|---|---|---|
| 3,018,455 | 9/1962 | Brandon et al. | 336/100 |
| 3,229,030 | 1/1966 | Baermann | 174/117 F |
| 3,241,198 | 3/1966 | Baermann | 335/303 |
| 3,462,715 | 8/1969 | Schor | 333/183 |
| 3,514,731 | 5/1970 | Drake | 335/285 |
| 3,684,955 | 8/1972 | Adams | 324/127 X |
| 3,838,213 | 9/1974 | Georgopulos et al. | 336/192 |
| 3,846,725 | 11/1974 | Mears, Jr. | 336/208 X |
| 4,005,380 | 1/1977 | Heilmann et al. | 336/176 X |
| 4,071,824 | 1/1978 | Kernander et al. | 336/176 X |
| 4,283,677 | 8/1981 | Niwa | 324/127 |
| 4,286,213 | 8/1981 | Fowler | 324/127 |
| 4,336,806 | 6/1982 | Eldridge, Jr. | 128/348 |
| 4,656,418 | 8/1987 | Boston, Jr. et al. | 324/127 |

FOREIGN PATENT DOCUMENTS

| | | | |
|---|---|---|---|
| 60-16404 | 1/1985 | Japan . | |
| 61-38714 | 3/1986 | Japan . | |
| 61-76626 | 5/1986 | Japan . | |
| 61-97899 | 6/1986 | Japan . | |
| 61-116021 | 7/1986 | Japan . | |
| 62-14770 | 4/1987 | Japan | 336/176 |
| 2179502 | 3/1987 | United Kingdom . | |

*Primary Examiner*—Thomas J. Kozma
*Attorney, Agent, or Firm*—Oliff & Berridge

[57] ABSTRACT

An electric noise absorber for holding a conduit of an electronic device comprises a retaining case composed of two box-shaped cases and auxiliary cases. A sponge-like member is fitted into the auxiliary case to prevent longitudinal movement of the cord or cable. A box-shaped case contains a magnet having a recess for receiving the cord or cable. It is possible to easily and securely attach and detach the electric noise absorber to the cord or cable by simply opening and closing the cases.

13 Claims, 5 Drawing Sheets

1

ELECTRIC NOISE ABSORBER

BACKGROUND OF THE INVENTION

This invention relates to an electric noise absorber for absorbing electric noise which is generated within an electronic device or which enters from the outside into the device through a line cord or cable.

As a method for absorbing such noise, it is well-known that a ferrite can be attached to encircle a line cord or cable. In this method, two pieces of half ring-shaped ferrite are simply attached by adhesive tape around the line cord. It is troublesome to attach the separate pieces to the line cord or cable and to detach the adhesive tape. Upon attachment of the noise absorber to line cord or cable, the pieces are apt to easily become detached from the line cord due to an uncovered state of the ferrite and it can not be used for an extended period of time. In addition, vibration may cause a displacement of the noise absorber from an initially-attached position on the line cord or cable.

SUMMARY OF THE INVENTION

It is an object of this invention to provide an electric noise absorber in which a magnetic body can be held securely to a line cord or cable for an extended period of time.

It is another object of this invention to provide an absorber that, whenever required, can easily be attached to and detached from the line cord or cable.

It is a further object of this invention to provide an absorber which can effectively absorb electric noise and prevent the noise generation and noise inflow to the electric device.

It is a further object of this invention to provide an absorber which can resist longitudinal movement by providing a press member.

These objects and other related objects are realized by an electric noise absorber (1) comprising: a magnetic body (3*a*,3*b*) axially divided and configured to enclose an outer periphery of an electric conduit (40); a retaining case (2) including a pair of cases (6,7) hingedly connected with each other for housing said magnetic body (3*a*,3*b*); an auxiliary case (10*a*,10*b*,11*a*,11*b*) connected to said retaining case; and an elastic press member (4) sized, shaped, positioned to fit into at least one of said auxiliary case and to hold said conduit (40) in use.

BRIEF DESCRIPTION OF THE DRAWINGS

This invention is illustrated diagrammatically in the following drawings wherein.

DETAILED DESCRIPTION OF PREFERRED EMBODIMENTS

An embodiment of this invention will be described with reference to FIGS. 1 through 7.

Figure 1:
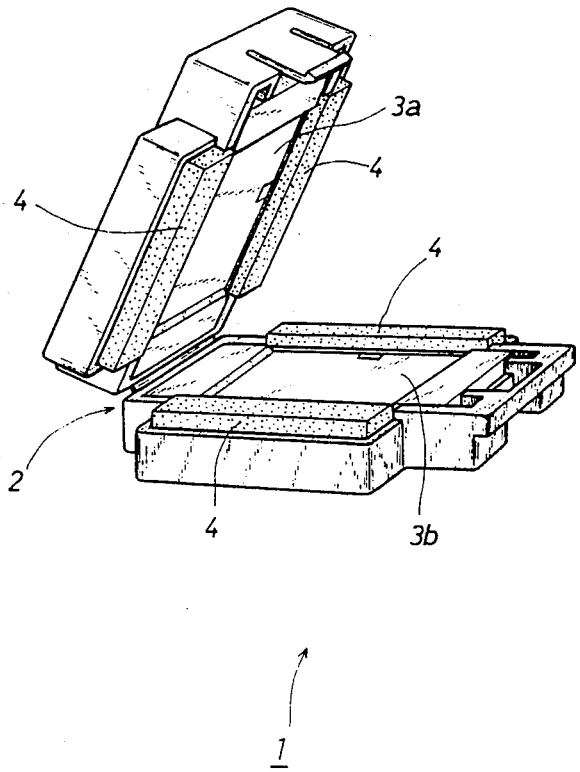
FIG. 1 is a perspective view illustrating an electric noise absorber of an embodiment according to the present invention.
Figure 2:
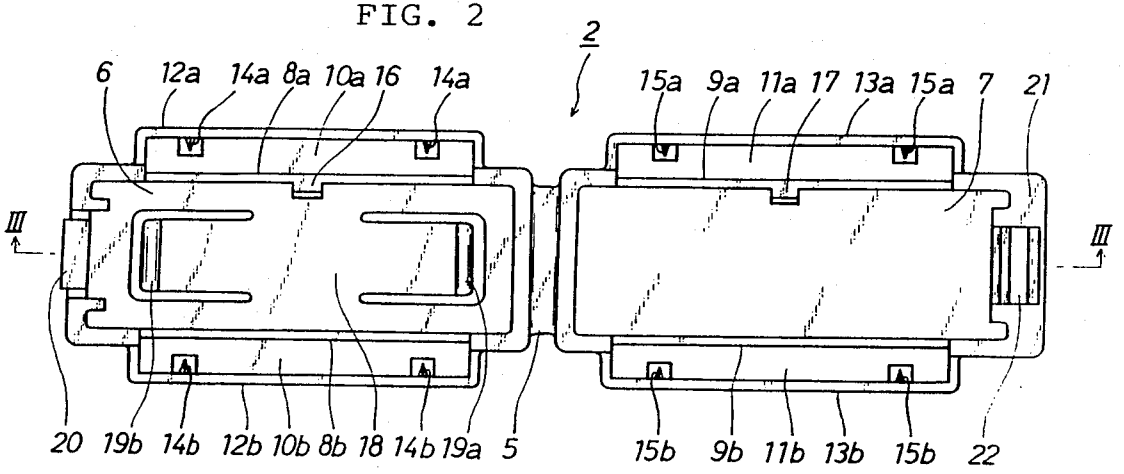
FIG. 2 is a top plan view of the retaining case of the embodiment shown in FIG. 1 in a half-opened state.
Figure 3:
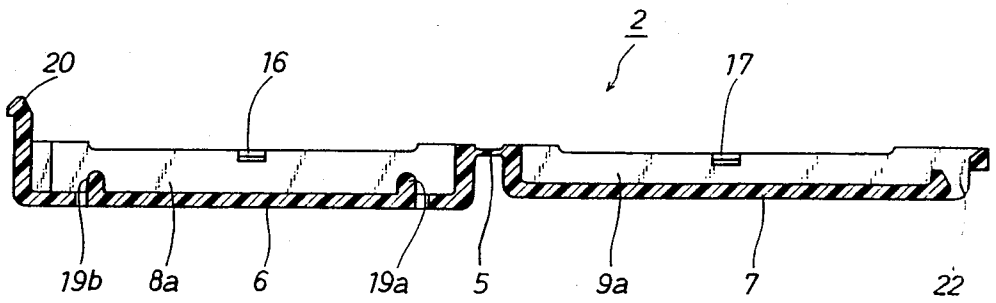
FIG. 3 is a sectional view of the retaining case taken along III—III line of FIG. 2.
Figure 4:
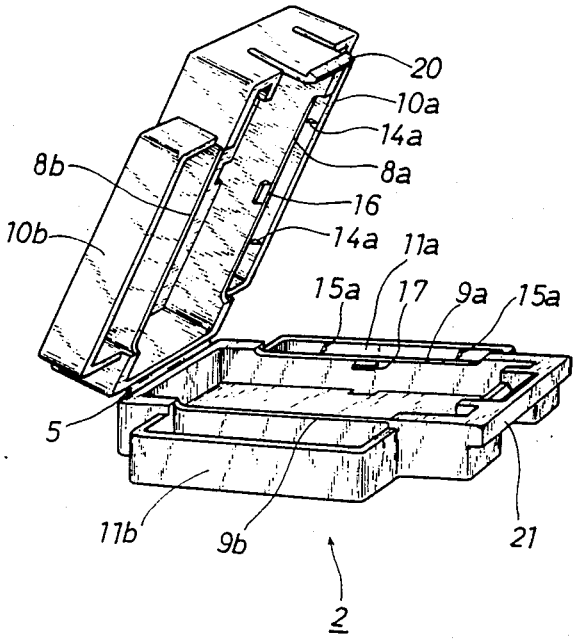
FIG. 4 is a perspective view of the retaining case of the embodiment in a half-opened state.

Referring to FIG. 1, an electric noise absorber 1 comprises a retaining case 2, a pair of ferrite bodies 3*a* and 3*b*, an elastic press member 4. Two cases 6 and 7 are connected by means of a strip hinge 5. The cases 6 and 7 are box-shaped with one open surface, and configured to securely contain therein ferrite bodies 3*a* and 3*b*. Side walls 8*a*, 8*b*, 9*a* and 9*b* of the cases 6 and 7 connect to a distal end of auxiliary cases 10*a*, 10*b*, 11*a* and 11*b* which house, respectively, therein the elastic press member 4. On the inside surfaces of the outside walls 12*a*, 12*b*, 13*a* and 13*b* of the auxiliary cases 10*a*, 10*b*, 11*a*, and 11*b* are provided with small projections 14*a*, 14*b*, 15*a*, 15*b* which project inwardly and engage with press members 4. Engagement pawls 16 and 17 extend from a center of inner surfaces of rear walls 8*a* and 9*a*, and engage with side notches 31*a*, 31*b* of the ferrites 3*a*, 3*b* shown in FIG. 5. A pair of resilient members 19*a* and 19*b* extend in a longitudinal direction of the case 6 from a bottom wall 18 of the case 6. These members 19*a* and 19*b* projects inwardly at end portion and presses upwardly (in FIG. 2) to the back surface of the ferrite 3*a*. A plate-like hook 20 is provided at a distal end of case 6 opposite to the end where the hinge 5 is provided. A rectangular through hole 22 is provided at an end 21 of case 7 for allowing the insertion of the hook 20. Referring to FIGS. 1 through 6, the elastic press members 4 are sized and positioned to fit tightly into the auxiliary cases 10*a*, 10*b*, 11*a* and 11*b*, and are shaped in a rectangular parallelopipe and they are greater in depth than the auxiliary cases.

Figure 5:
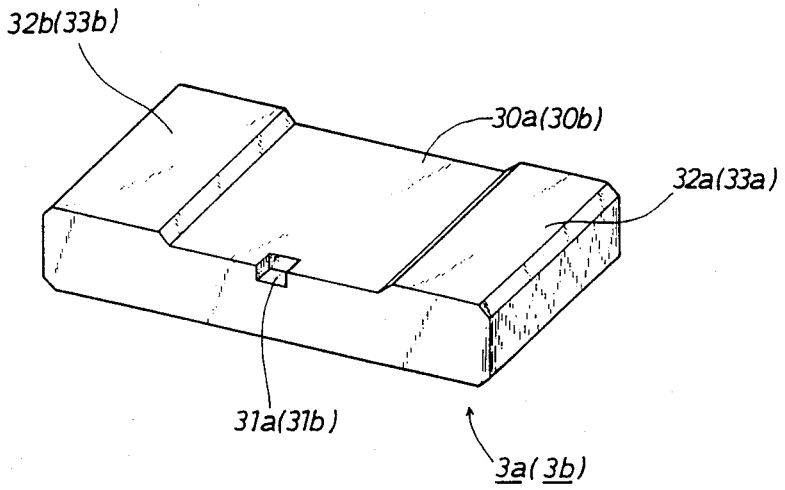
FIG. 5 is a perspective view of ferrite of the embodiment.
Figure 6:
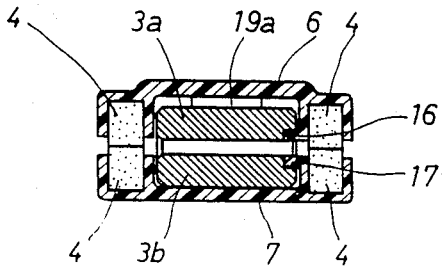
FIG. 6 is a sectional view of the electric noise absorber of the embodiment in the longitudinal direction in a closed and locked position.

Referring to FIGS. 5 and 6, the ferrite bodies 3*a* and 3*b* are shaped in a rectangular parallelepiped and provided with rectangular recesses 30*a* and 30*b* to enable the passage of the flat cable 40. Notches 31*a* and 31*b* provided at the center of the transverse edge of the recesses 30*a* and 30*b* to engage with engagement pawls 16 and 17.

The electric noise absorber 1 is assembled as hereinafter described. First, the ferrite 3*a* is fitted into the case 6 to engage the engagement pawl 16 with the notch 31*a* of the ferrite body 3*a*. Similarly, the ferrite body 3*b* is fitted into case 7 to engage the engagement pawl 17 with the notch 31*b* of the ferrite body 3*b*. The press members 4 are fitted tightly into auxiliary cases 10*a*, 10*b*, 11*a* and 11*b* so that small projections 14*a*, 14*b*, 15*a* and 15*b* dig into the press members 4. Next, the plate-like hook 20 is fitted into the hole 22 to secure the closed state of the retaining case 2. The plate-like hook 20 is manually manipulated toward hinge 5 to open the retaining case 2.

Figure 7:
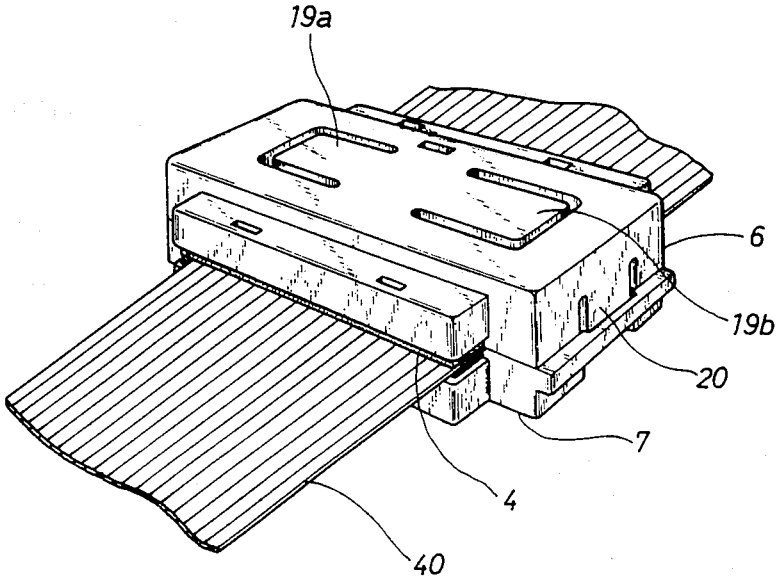
FIG. 7 is a perspective view of the electric noise absorber of the embodiment for retaining an electric conductor therein.

As shown in FIG. 7, the retaining case 2 holds a flat cable 40 in the ferrite bodies 3*a* and 3*b*. The resilient members 19*a* and 19*b* push the back surface of ferrite 3*a* thereby the abutment surfaces 32*a*, 32*b*, 33*a* and 33*b* are abutted to each other. The ferrite bodies 3*a* and 3*b* tightly encircle the flat cable 40. The press member 4 is configured to fit onto the cable 40 to resist longitudinal sliding of the cable in the noise absorber.

The electric noise absorbers 1 contain the ferrite bodies 3*a* and 3*b*, and encircle the cable 40 with the ferrite bodies 3*a* and 3*b*. By applying an appropriate number of the electric noise absorbers 1, the electric noise flowing in the cable is absorbed by the ferrite body, and the generation of noise is prevented. Noise is measured at various positions along the cable 40 by a noise measuring device. The position where noise is absorbed most efficiently is determined, and the noise absorber is located to the correct position. It is preferable that the most appropriate number of the noise absorbers to be used are experimentally determined by measuring the noise absorbing efficiency. The ferrite bodies 3*a* and 3*b* absorb the electric noise that is generated outside or enters the electronic device through the cable 40.

The plate-like hook 20 is pushed toward the hinge 5 so as to detach the cases 6 and 7 from the cable or to change position of the cases 6 and 7. Easy attachment of the cases 6 and 7 and their detachment from the cable 40 of the cases 6 and 7 are attained. It is also possible to secure the retaining case 2 to a portion of the electronic device with a double-sided adhesive tape on the cases 6 and 7.

Regarding the retaining case 2, it is made of a synthetic resin, alternatively another material such as an insulator (e.g. paper) can be employed. The press member 4 is made of elastic material such as sponge or rubber. Press members 4 juxtaposed may be fitted into one of the cases 6 and 7 or into one opposing portion of cases. Moreover the press member 4 may be attached on outer surfaces of side walls 8*a*, 8*b*, 9*a*, and 9*b* by adhesive in place of housing the auxiliary cases 10*a*, 10*b*, 11*a*, 11*b*. Regarding the magnetic substance, either hard or soft ferrite can be used. Further, a plastic or rubber magnet which is made by mixing magnetic powder of ferrite with plastic or rubber can also be used.

Obviously many modifications and variations of the present invention are possible in the light of the above teachings. It is therefore to be understood that within the scope of the appended claims in the invention may be practiced otherwise than as specifically described.

What is claimed is:

1. An electric noise absorber comprising:

a magnetic body abutably divided into two parts, each of said two parts having an abutment surface which has a recess and said magnetic body configured to enclose a portion of an electric conductor;

a retaining case including a pair of cases hingedly connected with each other for holding said magnetic body;

an auxiliary case connected to and adjacent a side of said retaining case, said auxiliary case including at least one cavity; and an elastic press member sized, shaped, and positioned to fit into a cavity of said auxiliary case and to engage and hold a conductor when said retaining case is in a closed condition about the conductor.

2. An electric noise absorber as defined in claim 1, wherein a pair of resilient members are provided at one of said cases for pressing said magnetic body (3*a*,3*b*).

3. A electric noise absorber as defined in claim 1, wherein a pair of engaging members are provided on an inside surface of said cases for engaging with a notch (31*a*,31*b*) of said magnetic body.

4. An electric noise absorber as defined in claim 1, wherein at least a pair of small projections are provided on said auxiliary cases for piercing and engaging into said elastic pres members.

5. An electric noise absorber as defined in claim 1, wherein each of said two cases of said retaining case has a detachable connecting means at opposite edge to the edge provided with the hinge.

6. An electric noise absorber as defined in claim 5, wherein said detachable means includes a plate-like hook and a through hole, said plate-like hook is provided on an end of one of said cases, pivoted about a hinge and fitted into said through hole provided at an end of another case in a closed and locked position.

7. An electric noise absorber as defined in claim 5, wherein said hinge is a strip.

8. An electric noise absorber as defined in claim 1, wherein said two parts of said magnetic body are provided with a recess allowing abutment of an electric conductor.

9. An electric noise absorber as defined in claim 1, wherein said press member and said auxiliary cases are shaped in a rectangular parallelopipe.

10. An electric noise absorber as defined in claim 1, wherein said elastic press member has a size in depth greater than of auxiliary case.

11. An electric noise absorber as defined in claim 1, said magnetic body is ferrite.

12. An electric noise absorber as defined in claim 1, wherein said magnetic body is configured to enclose a portion of a flat electric cable.

13. An electric noise absorber comprising:

a magnetic body abutably divided into two parts, each of said two parts having an abutment surface which has a recess and said magnetic body configured to enclose a portion of an electric conductor;

a retaining case including a pair of cases hingedly connected with each other for holding said magnetic body; and elastic press member means for engaging and holding a conductor when said retaining case is in a closed condition about an electric conductor, said elastic press member means being located adjacent a side of said retaining case.

* * * * *